US006629555B2

(12) United States Patent
DeBlock et al.

(10) Patent No.: US 6,629,555 B2
(45) Date of Patent: Oct. 7, 2003

(54) RETRACTABLE SCREEN DOOR

(75) Inventors: David A. DeBlock, Holland, MI (US); Keith Early, Wyoming, MI (US); Michael S. Eveland, Fennville, MI (US); Benjamin P. Hummel, Cedar Springs, MI (US)

(73) Assignee: ODL, Incorporated, Zeeland, MI (US)

( * ) Notice: Subject to any disclaimer, the term of this patent is extended or adjusted under 35 U.S.C. 154(b) by 0 days.

(21) Appl. No.: 10/044,462

(22) Filed: Oct. 25, 2001

(65) Prior Publication Data

US 2003/0079844 A1 May 1, 2003

(51) Int. Cl.[7] ..... A47H 1/00

(52) U.S. Cl. ..... 160/31; 160/275; 160/315; 192/56.61; 292/DIG. 46

(58) Field of Search ..... 160/23.1, 24, 31, 160/26, 267.1, 275, 290.1, 315, 196.1; 16/93 R, 87.4 R, 87.6 R; 192/56.61; 292/DIG. 46

(56) References Cited

U.S. PATENT DOCUMENTS 586,656 A * 7/1897 Fishbaugh ..... 160/275
1,947,070 A * 2/1934 Traut ..... 160/23.1
1,972,182 A 9/1934 Chamberlain, Jr. et al.
3,092,170 A * 6/1963 Ellis ..... 160/26
4,458,739 A * 7/1984 Murray et al. ..... 160/23.1
4,651,797 A 3/1987 Lange
4,821,786 A 4/1989 Johnston
4,825,921 A 5/1989 Rigter
5,505,244 A 4/1996 Thumann
5,522,445 A * 6/1996 Hoffman ..... 160/183
5,758,704 A 6/1998 Elrod
6,059,007 A 5/2000 Tomita
6,082,432 A 7/2000 Kissinger
6,209,610 B1 * 4/2001 Davies et al. ..... 160/26
6,397,921 B1 * 6/2002 Wartenbergh ..... 160/267.1
6,408,922 B2 * 6/2002 Desrochers ..... 160/24
6,478,070 B2 * 11/2002 Poppema ..... 160/23.1

* cited by examiner

*Primary Examiner*—Blair M. Johnson
(74) *Attorney, Agent, or Firm*—Warner Norcross & Judd

(57) ABSTRACT

A retractable screen door for drawing a flexible screen panel across an opening, including a flexible screen wound around a spring biased take-up shaft, and guide rails for guiding the screen as it is moved across the opening. A unique latch mechanism is disclosed, said latch mechanism being located in the guide rails. Further, the screen may include an adjustable gear assembly for changing the tension on the spring. The retractable screen is optionally designed to have the appearance of a common door casing.

16 Claims, 9 Drawing Sheets

RETRACTABLE SCREEN DOOR

BACKGROUND OF THE INVENTION

This invention relates to door screens. More specifically, this invention relates to horizontally movable door screens rotatably mounted on a take-up shaft and capable of being rolled and unrolled from a vertically oriented storage member.

There are a number of examples in the prior art of rolling screens for use with doors. In general, these screens consist of a latch member and a vertically oriented take-up roll located in front of a door frame member. The latch member tends to be vertically oriented on the door frame member opposite the take-up roll. The take up roll has a screen rotatably mounted on it, which can be extended and retracted according to the users needs. Though functional, the prior art screens do have some significant problems.

The most common problem is that many screens are open at the upper and lower edges. With these designs the screen is only connected to the latch member and the take-up shaft, thus leaving the upper and lower portion of the screen open. This allows insects and other debris to enter the building through the screen, which decreases the effectiveness of the screen.

Some designs solve this problem by placing guide rails on the top and bottom of the door opening. The screen moves within these guide rails as it is extended across the opening, thus creating a better seal. However, the screen is easily dislodged from the typical guide rail. Minimal twisting of the screen as it is moved through the screen door assembly can cause the screen to be removed from the rails, thus making use of the screen more difficult.

Another problem comes with the latch mechanism for the screen. Latching a screen in place often involves time consuming steps. A typical screen will have either a handle or hook-and-eye latch mechanism. A handle latch will have a handle portion that locks within a latch portion. This can be done by placing a retainer mechanism, or latch portion, for the handle portion within a vertical member. The vertical member will be located on the opposite side of the opening from the take-up shaft. These latch mechanisms can be tedious to use and are prone to breaking. In addition, latching and unlatching these assemblies can be time consuming.

The hook-and-eye latch requires holes, or eyes, within the screen to be aligned with hooks located on the vertical member. The hooks, which operate as the latch portion, are then placed through the eyes to hold the screen in place. Again, this process can be tedious and time consuming. The inconvenience of aligning the hooks and eyes every time the screen must be closed discourages use of the screen.

A further problem with prior rolling screen designs is that there is no way for a user to easily adjust the winding speed of the screen. To change the speed at which the screen winds, the torque on an internal spring must be changed. To do this on most screens, the take-up shaft must be disassembled to gain access to the spring. Even if access is gained, there is often no mechanism for adjusting the tension of the spring within the take-up shaft. The process of changing the tension on the spring is too difficult for an average consumer to do, so as a practical matter the speed of winding can not be changed on a typical rolling screen. Additionally, on prior art screen doors it is possible to over tension the coil spring causing a dangerous high speed return of the handle portion.

Finally, most rolling screens require a large housing to conceal the take-up shaft and screen. The vertical members, if used, are much smaller than the take-up shaft housings, so the door opening will not be symmetrical. In addition, the large housing and vertical member are very different in size from normal door moldings, so they tend to make the building unattractive. If guide rails are used on the top and bottom, these again detract from the appearance of the door opening. The lower rail can also create a tripping hazard if it is unnoticed by a user. As a result of these problems, many people will choose not to use rolling screens for aesthetic and safety reasons.

SUMMARY OF INVENTION

The aforementioned problems are overcome by the present invention wherein a screen door is provided which includes a take-up shaft attached to an adjustable gear assembly for winding the spring, a screen rotatably wound on the take-up shaft, a screen case which encloses the screen and take-up shaft, a handle, preferably with endcaps, attached to the screen, and upper and lower guide rails possibly containing a unique latch mechanism.

The upper and lower guide rails may have ribs for guiding the screen as it is extended. The endcaps of the handle, which should be wider than the opening for the screen in the guide rails, ride along the ribs as the handle is pulled from the screen case. Since the endcaps are wider than the opening in the guide rails, the handle, and thus the screen, is positively retained within the rails as the screen is extended.

At the end of the guide rails, the ribs are removed. In this configuration when the handle reaches the end of the rails, the endcaps slip off the ribs. The endcap at the top of the handle then rests on a shelf within the upper guide rail. This simple procedure latches the screen in place.

The take-up shaft is attached to a gear assembly with a front access hole. A simple tool, such as a hexagonal wrench, can be inserted into the gear assembly to adjust the tension on the spring attached to the take-up shaft. This will change the force on the spring and effect the speed with which the screen is retracted into the screen case when it is unlatched. The gear assembly also includes a clutch mechanism that limits the maximum torque applied to the spring by the gear assembly.

In addition, the screen case is preferably molded to have the appearance of a typical door molding. A similar molding may be placed opposite the screen case to give the appearance of a normal door casing. The mantle can also be molded in a similar manner. The upper guide rail will be added to or incorporated into the mantle.

The lower guide rail is incorporated into a typical doorsill, which reduces the risk of tripping over the guide rail when entering or leaving through the door.

DETAILED DESCRIPTION OF THE PREFERRED EMBODIMENT

Figure 1:
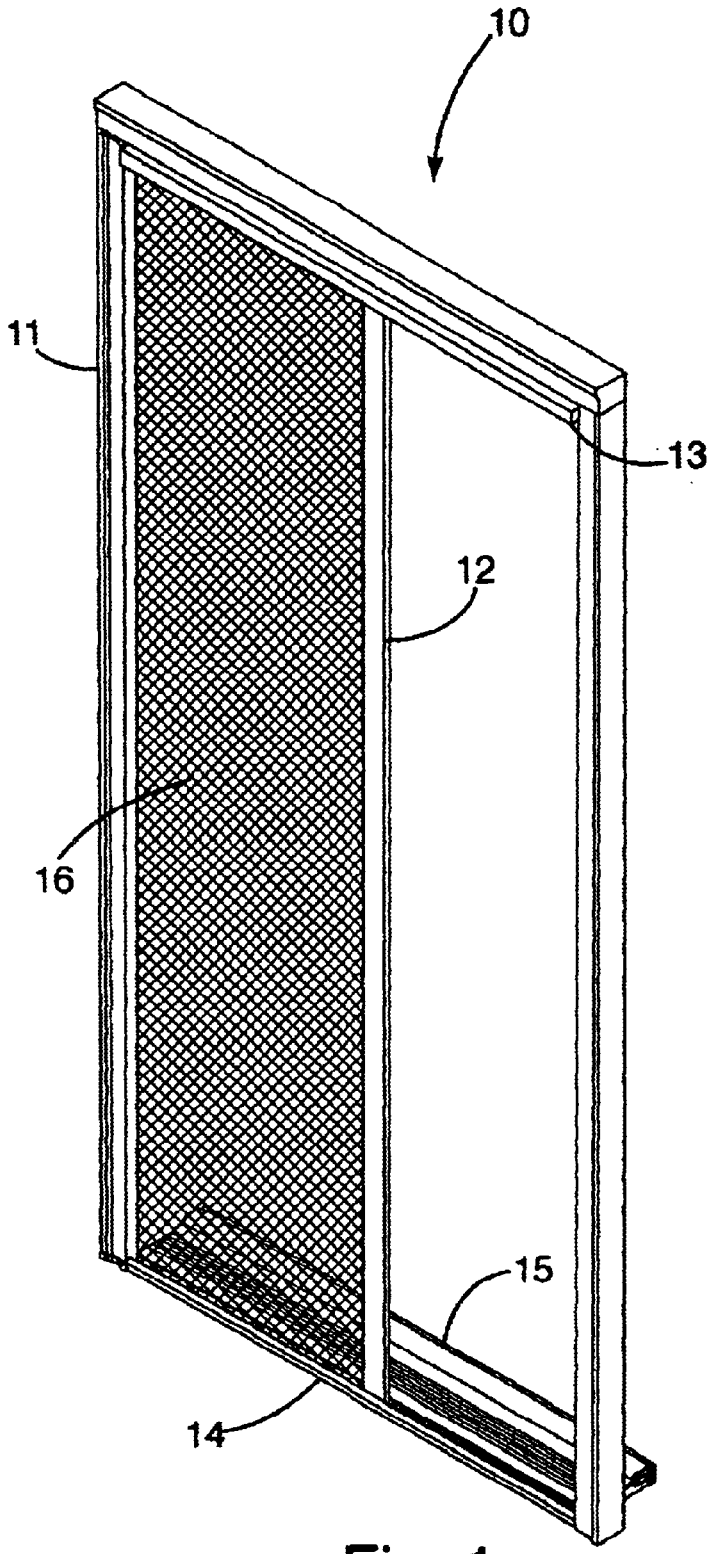
FIG. 1 is a front view of a rolling screen according to a preferred embodiment of the invention.

A retractable screen door constructed in accordance with a preferred embodiment of the invention is illustrated in the drawings and designated 10. While the screen will be explained for use with a door, it is to be understood that the retractable screen may be used for any opening. In addition, while the screen will be explained in relation to exterior use, it is to be understood that the design is suitable for both interior and exterior use.

A screen 16 is pulled from a pillar housing 11 by handle 12 across an opening. The screen 16 is guided by upper and lower guide rails, 13 and 14 respectively, as it is pulled from pillar housing 11. Lower rail 14 is incorporated into doorsill 15 and forms part of the door casing.

Figure 2:
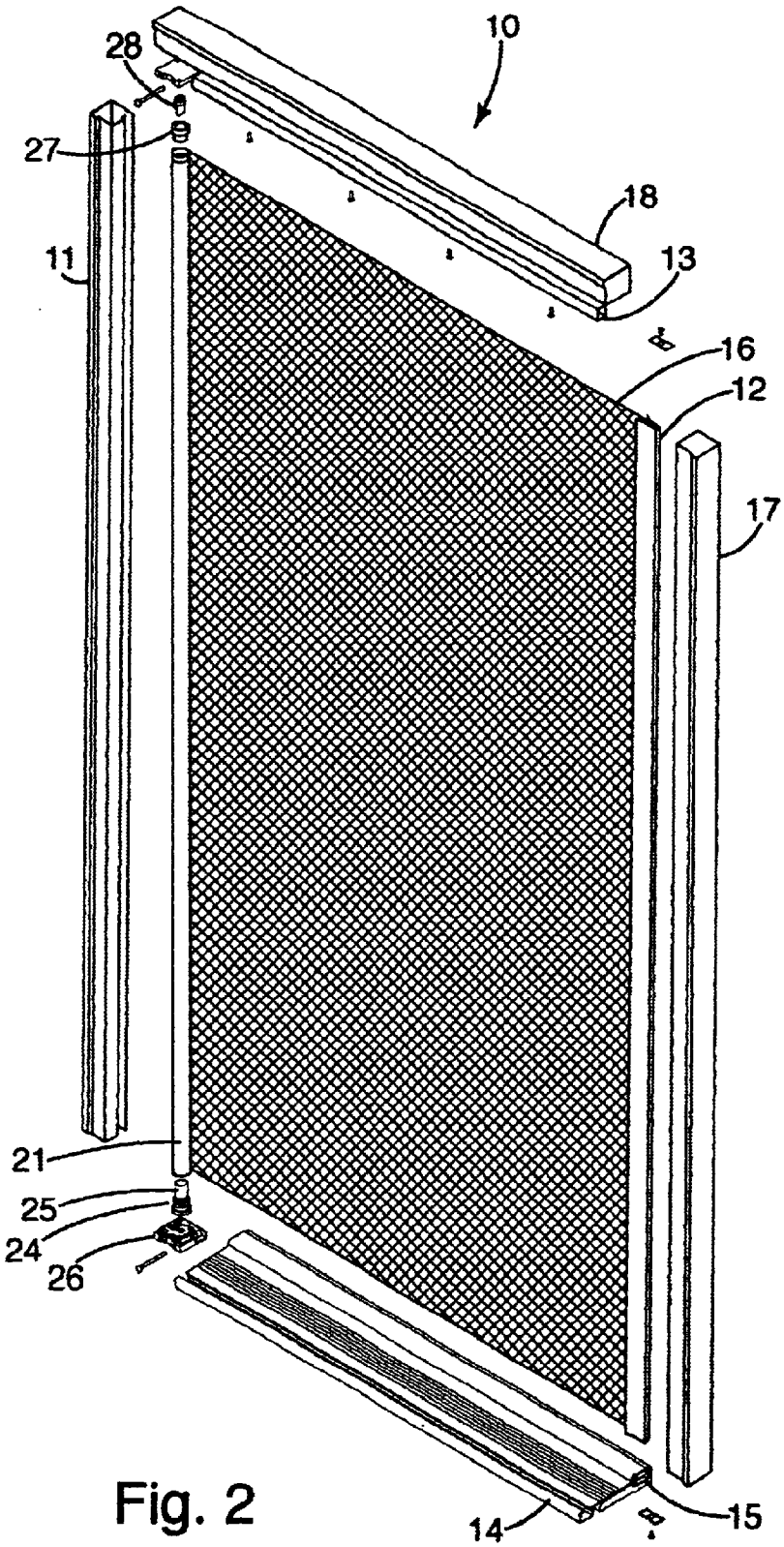
FIG. 2 is an exploded view of the rolling screen.

FIG. 2 shows the major components of the screen door 10. The screen door 10 has four basic framing members. In the preferred embodiment the four framing members are connected to the doorjamb. It is required is that the framing members be in contact in the configuration specified. A pillar housing 11 is a hollow pillar designed to be vertically mounted on one side of a door opening. A solid pillar 17 is designed to be vertically mounted on the side of a door opening opposite the pillar housing 11. A mantle 18 is a molding, including a guide rail 13 to be explained later, designed to be abutted to, and mounted horizontally above, the pillar housing 11 and solid pillar 17. Lower rail 14 is designed to be mounted horizontally between the pillar housing 11 and the solid pillar 17. The lower rail 14 is preferably mounted to doorsill 15. The sill 15 is a typical doorsill. The design of the combined doorsill 15 and lower rail 14 will be discussed in further detail below.

The exemplified screen door 10 further includes a take-up shaft 21. The screen 16 is made of a flexible material, attached to the take-up shaft 21 along one edge, and wound around the take-up shaft 21. A handle 12 is attached to the screen 16 in such a way as to allow the screen 16 to be extended across a door opening by the handle 12. The screen 16 is centered on the handle 12.

Figure 3:
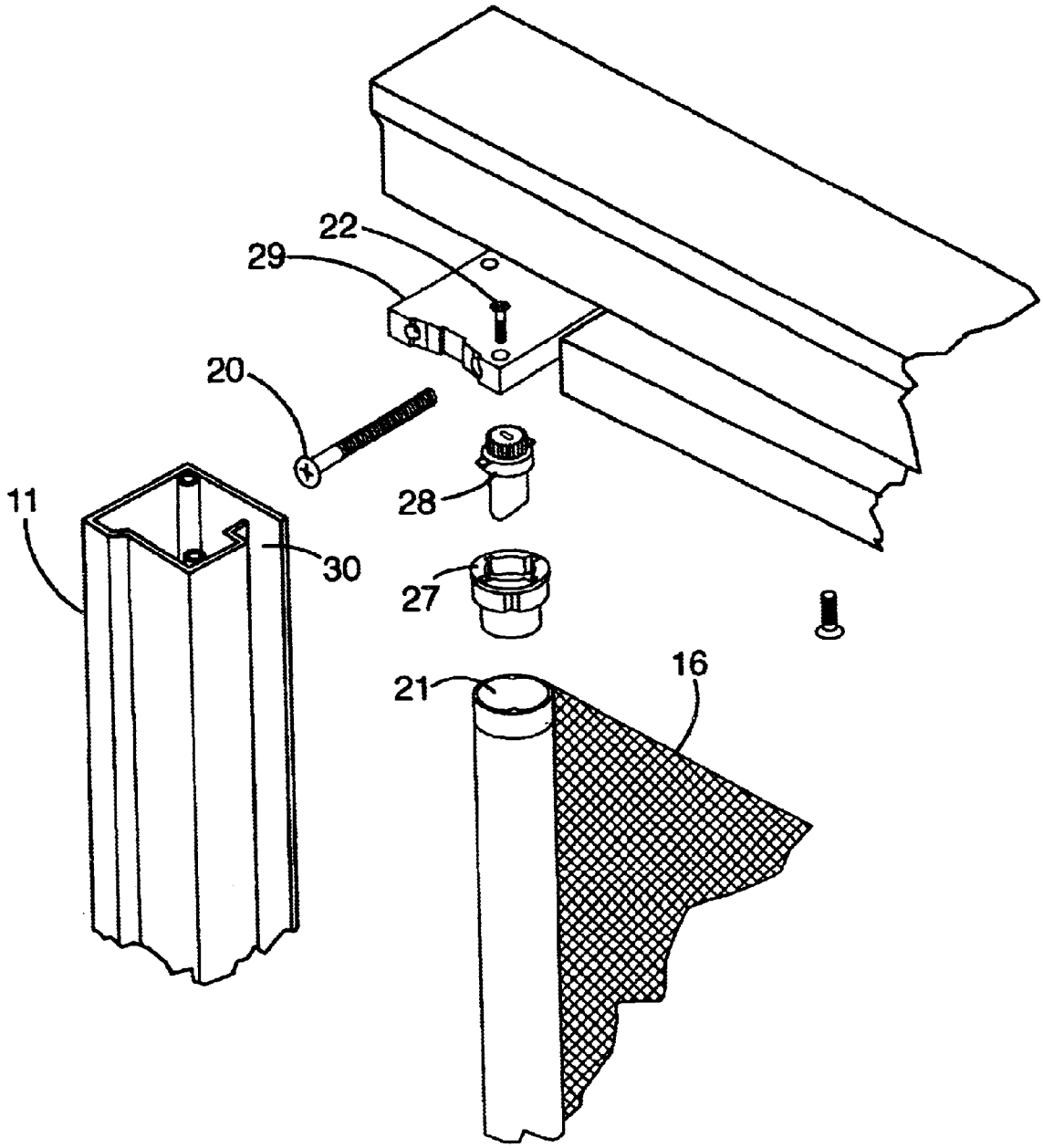
FIG. 3 is an exploded fragmentary view of the upper portion of the pillar housing and rolling screen.

FIG. 3 shows an exploded view of the upper portion of the screen door assembly, including a damper housing 27 which is attached to the top of the take-up shaft 21, and a damper 28 is inserted into the damper housing 27. The damper 28 and damper housing 27 can be any damper assembly known in the art, and can be attached at either end of the take-up shaft 21. The take-up shaft 21, screen 16, coil spring 24, and damper housing 27 should be concealed within the pillar housing 11. The damper 28, if present, or take-up shaft 21 is rotatably mounted to the pillar cap 29. The pillar cap 29 can be attached to the structure where the screen door is mounted by use of fastener 20. Fastener 20 can be any fastener capable of securing the pillar cap 29 to a structure, such as a wood screw. The pillar cap 29 can be attached to the pillar housing 11 by any reasonable fastening means, for example screws 22 (one of which is not shown).

The take-up shaft 21 is preferably located approximately in the center of the pillar housing 11. When wound around the take-up shaft 21, the screen 16 fits within the pillar housing 11. The handle 12 is attached along the free edge of the screen 16, as previously shown. The handle 12 preferably fits within a pillar slot 30 in the pillar housing 11. The handle 12 protrudes from the pillar slot 30 sufficiently to allow a user to grasp the handle 12 when he wishes to extend the screen 16. The screen 16 is positioned so that, as the handle 12 is pulled, the screen 16 is extended through pillar slot 30.

Figure 4:
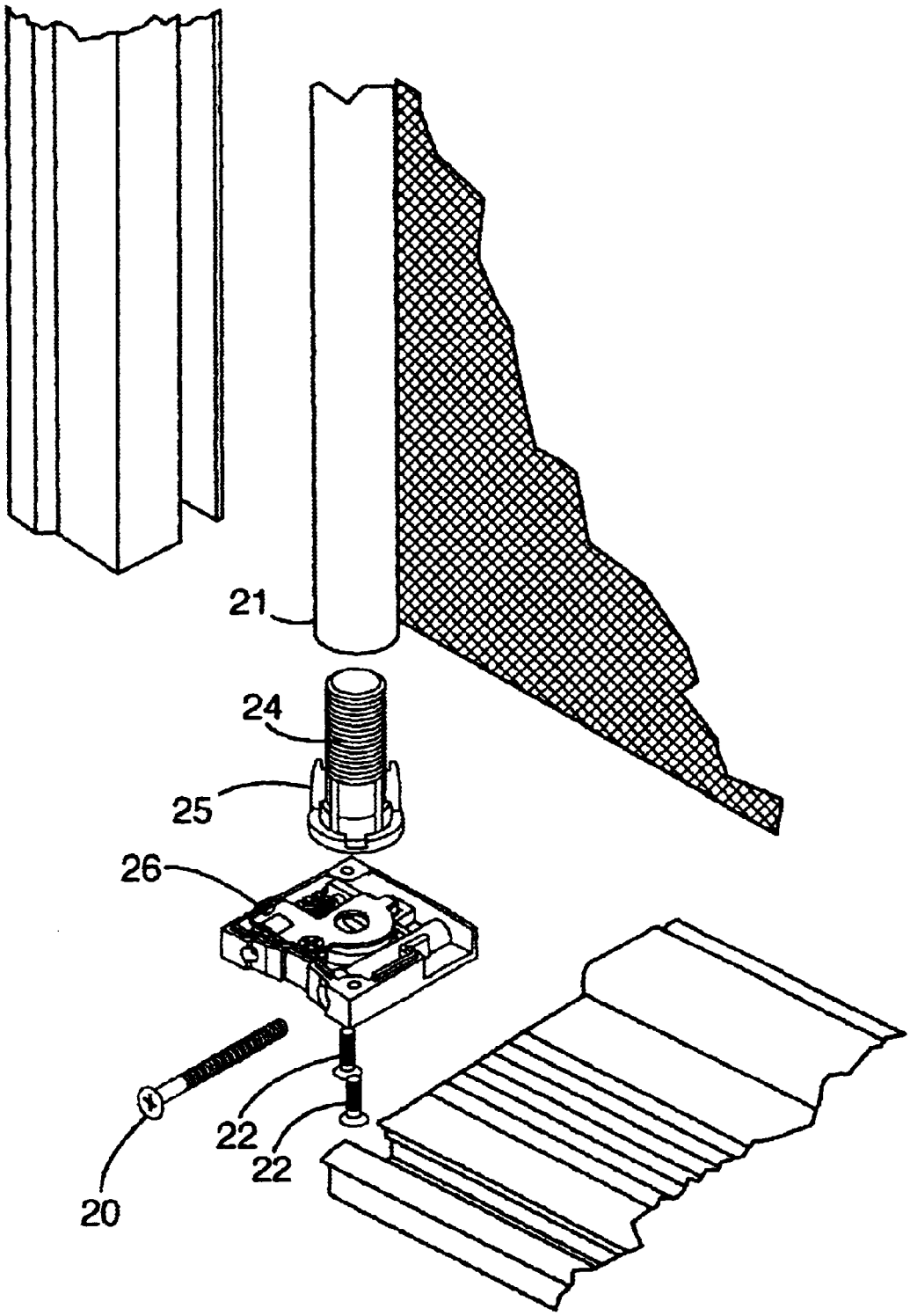
FIG. 4 is an exploded fragmentary view of the base of the pillar housing, rolling screen and gear assembly.

FIG. 4 shows a coil spring 24 wound around a spring subassembly 25, which is attached to the take-up shaft 21 near the base of the take-up shaft 21. The coil spring 24 and spring subassembly 25 can be attached at either end of the take-up shaft 21, but should be attached at the end of the take-up shaft 21 opposite the damper 28, if present. The spring subassembly 25 is also attached to the gear assembly 26, which is used to adjust the tension on the coil spring 24. A protrusion at the base of the spring subassembly 25 is designed to fit within a slot in the gear assembly 26. The gear subassembly 26 is attached to the pillar housing 11 using any reasonable fastening means, such as screws 22. A fastener 20 can also be used to attach the gear assembly 26 to the structure the screen door 10 is mounted on.

The screen 16 is extended past a door opening by pulling handle 12. As handle 12 is pulled, the screen 16 moves though upper rail 13 and lower rail 14. The screen 16 can be maintained in the extended position by use of a latch mechanism. This can be by a conventional latch mechanism, many of which are known in the art, or by the novel latch mechanism discussed further in this application. When the screen 16 is latched, it preferably covers the entire door opening.

Figure 5:
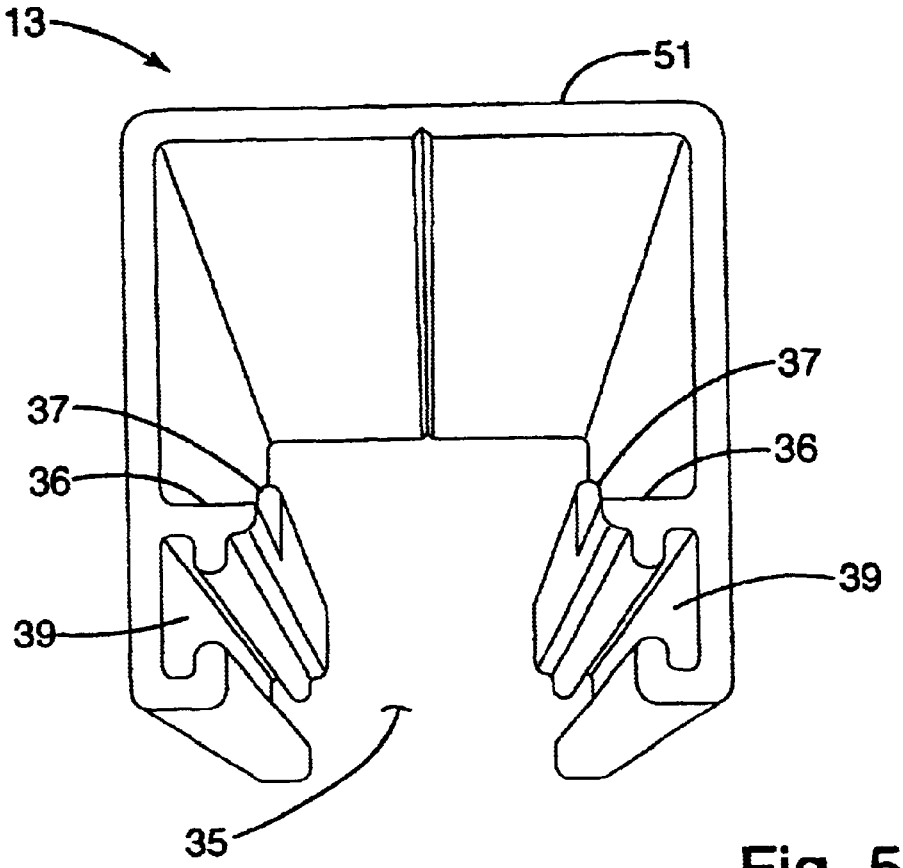
FIG. 5 is a side view of the upper rail.

The upper rail 13, which can be seen in FIG. 5, has a screen opening 35 through which the screen 16 advances. A guide ledge 36 is located above the screen opening 35. Optionally ribs 37 are located on the guide ledge 36 and run the length of the upper rail 13. While the ribs 37 can run the entire length of the upper rail 13, in an exemplified embodiment the ribs 37 stop before the end of the upper rail 13 that is abutted to the solid pillar 17. This latter configuration of the ribs 37 forms part of the unique latch mechanism to be discussed further in this application. Additionally, brushes 38 can be inserted into brush slots 39 in the upper rail 13. The brushes 38 keep insects and debris from entering the upper rail 13.

Figure 6:
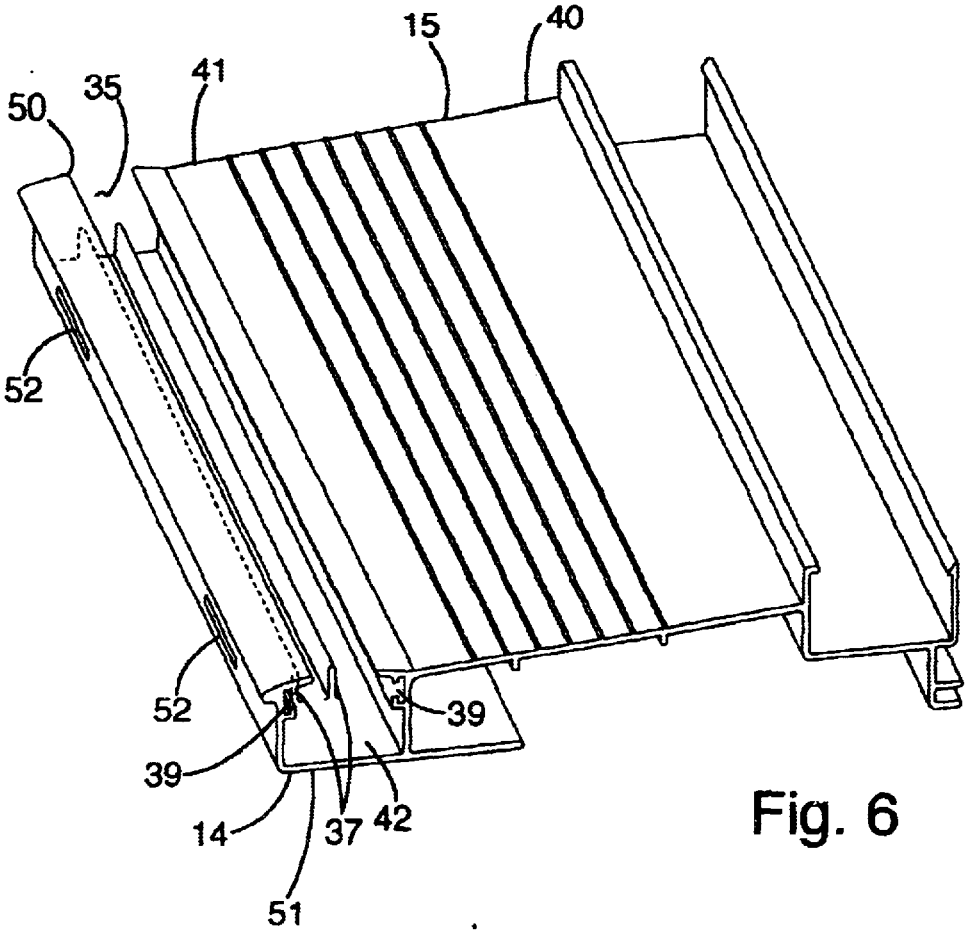
FIG. 6 is a side view of the lower rail and novel latch mechanism.

FIG. 6 shows the lower rail 14 and doorsill 15, the lower rail 14 being incorporated into the doorsill 15. The doorsill 15 is designed to function like a typical doorsill. The doorsill 15 is usually a wedge shape, which is designed to slope down from the doorway, having an upper end 40 and a lower end 41. The lower rail 14 is designed to have a low profile so it will align with the lower end 41 of the doorsill 15, the lower end 41 being the end farthest from the doorway. The lower rail 14 is preferably attached to the doorsill 15 at the lower end 41. Since the lower rail 14 aligns with the lower end 41, the possibility of tripping over the lower rail 14 is minimized.

The lower rail 14 has a screen opening 35 through which the screen 16 advances. The lower rail includes ribs 37 along the bottom 42. These ribs 37 run most of the length of the lower rail 14, but the ribs 37 stop near the end of the lower rail 14 abutted to the solid pillar 17. This latter configuration of the ribs 37 forms part of the unique latch mechanism to be discussed further in this application. Additionally, brushes 38 are included in brush slots 39 in the lower rail 14. These brushes 38 perform similar functions to the brushes 38 in the upper rail 13. Additionally, the lower rail 14 can include weep holes 52. The weep holes 52 allow water to drain from the screen door 10, for instance after a rainstorm. The weep holes 52 are preferably are slot shaped and are placed very low on the side of the lower rail 14 to allow the maximum amount of water to drain through the weep holes 52.

Figure 7:
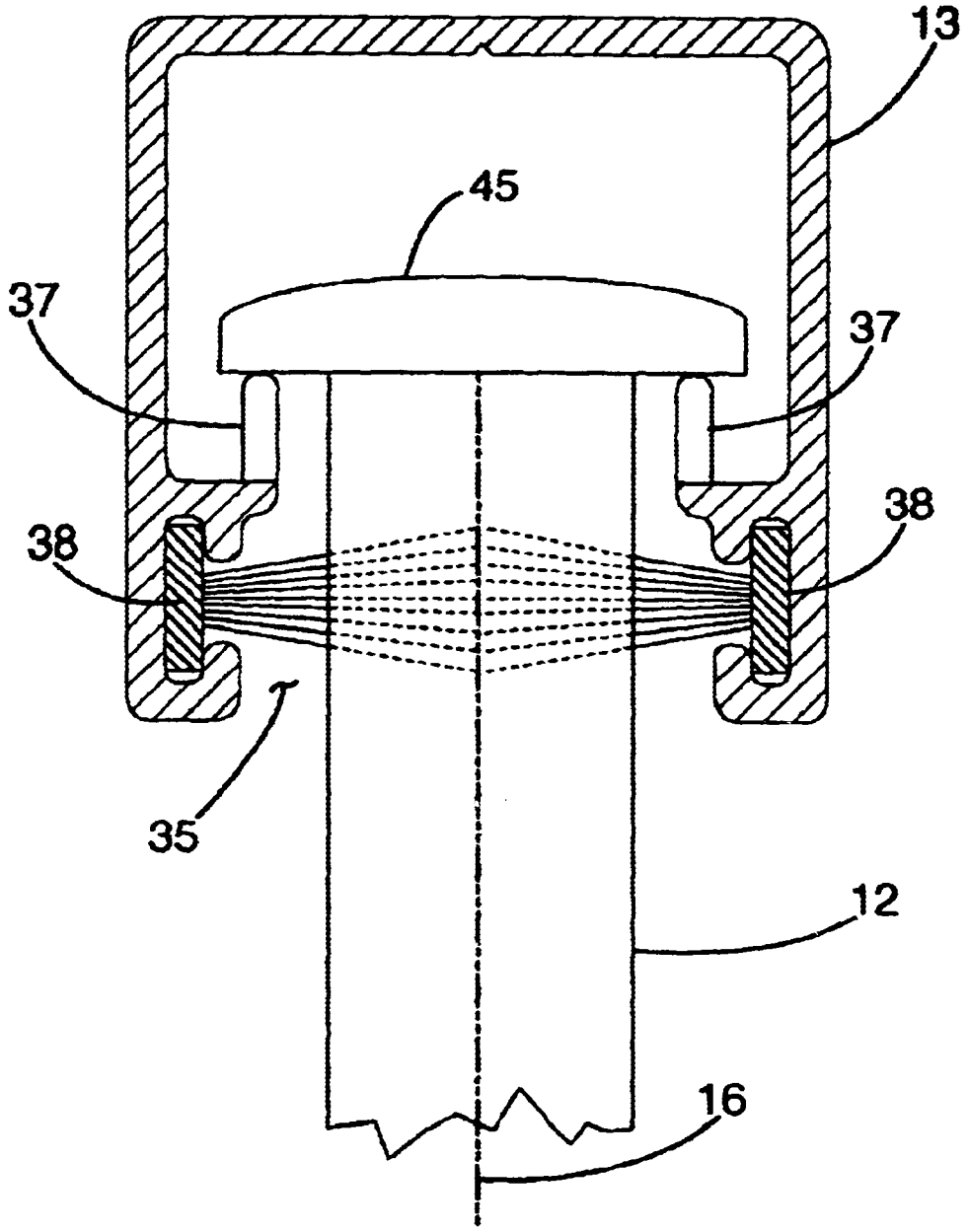
FIG. 7 is a side view of the upper rail and handle.
Figure 8:
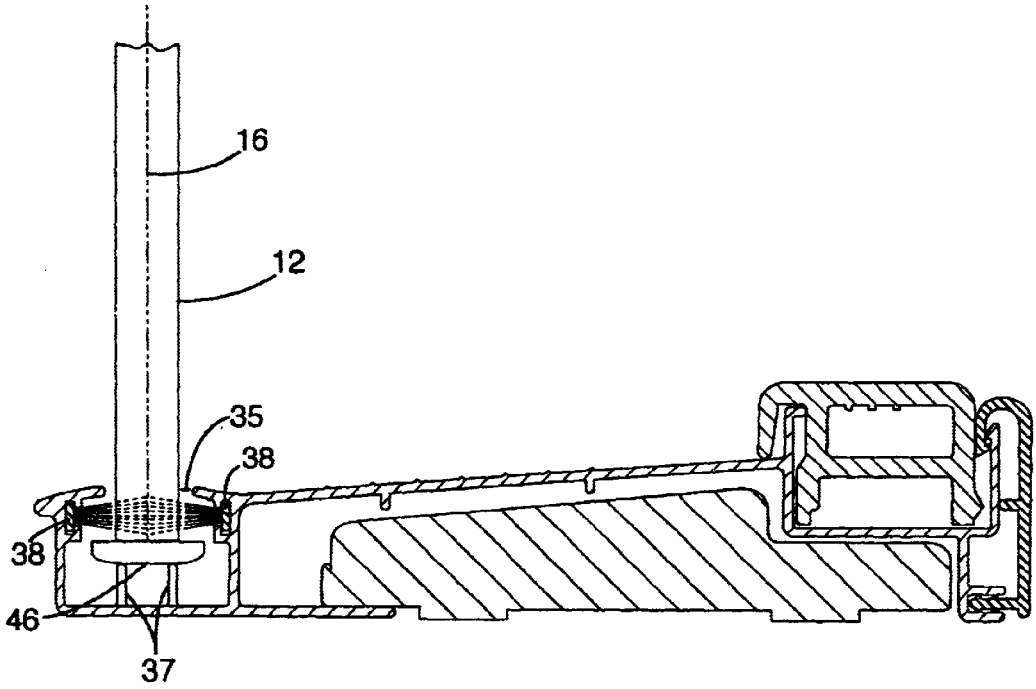
FIG. 8 is a side view of the lower rail detail and doorsill.

FIG. 7 and FIG. 8 show the screen 16 as it is being advanced through the upper rail 13 and lower rail 14. The handle 12 preferably has a top cap 45 and bottom cap 46. The top cap 45 and bottom cap 46 are preferably larger than the screen openings 35 in the upper rail 13 and lower rail 14. If the top cap 45 and bottom cap 46 are larger than the screen openings 35, it will not be possible to accidentally remove the screen handle 12 during use, since the top cap 45 and bottom cap 46 are attached to the screen handle 12 and can not be removed from the upper rail 13 or lower rail 14. The top cap 45 and bottom cap 46 glide along ribs 37 in the upper rail 13 and lower rail 14, if ribs 37 are present.

Figure 9:
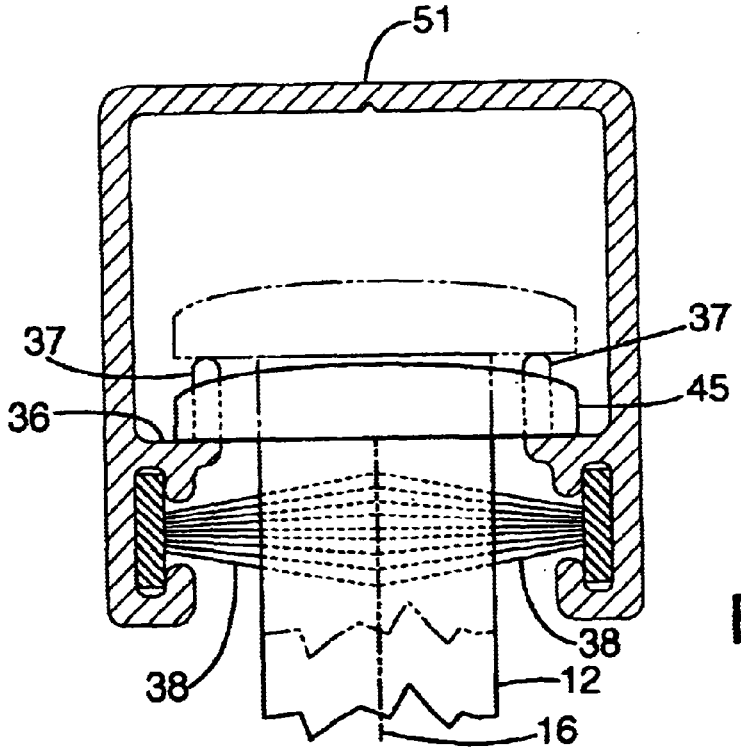
FIG. 9 is a side view of the upper rail and novel latch mechanism.
Figure 10:
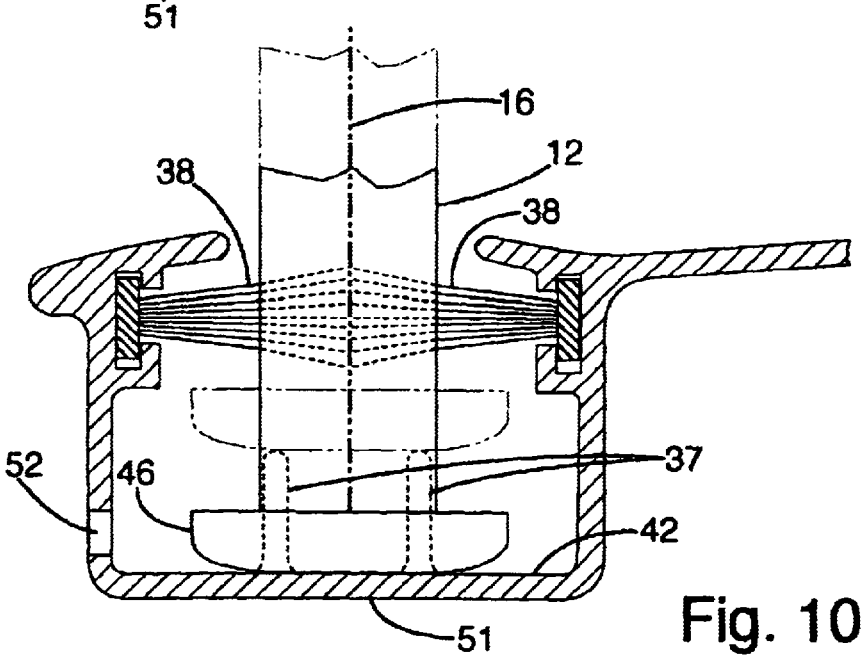
FIG. 10 is a side view of the lower rail detail and doorsill.

FIG. 9 and FIG. 10 show the latch mechanism referred to earlier. In the preferred embodiment of the latch mechanism ribs 37 are present in both the upper rail 13 and lower rail 14. The ribs 37 in the upper rail 13 run from the housing end 50 almost to the pillar end 51. The ribs 37 end before reaching the pillar end 51, leaving enough space for the top cap 45 to slip off the ribs 37 and rest on the guide ledge 36. The ribs 37 in the lower rail 14 similarly run from the housing end 50 almost to the pillar end 51. The ribs should end prior to the pillar end 51, leaving enough space for the bottom cap 46 to slip off the ribs 37.

In an exemplified embodiment, the height of the ribs 37 in the upper rail is ⅛" and the height of the ribs 37 in the lower rail is ¼". In this configuration the top cap 45 will rest on the guide ledge 36 and the bottom cap 46 will hang suspended within the lower rail 14. It is possible to have the heights of the ribs 37 be equal in the upper rail 13 and lower rail 14, which would allow the bottom cap 46 to rest on the bottom 42 of lower rail 14 and the top cap 45 to rest on the guide ledge 36.

As can be seen from FIG. 9 and FIG. 10 the top cap 45 and bottom cap 46, after slipping from the ribs 37, will be blocked from retracting by the ribs 37. This will keep the screen 16 in an extended position when in the latched position. When the user wishes to retract the screen 16, the handle is lifted so the ribs 37 no longer block the top cap 45 and bottom cap 46. If the handle 12 is released in this position, the coil spring 24 will retract the screen 16.

Figure 11:
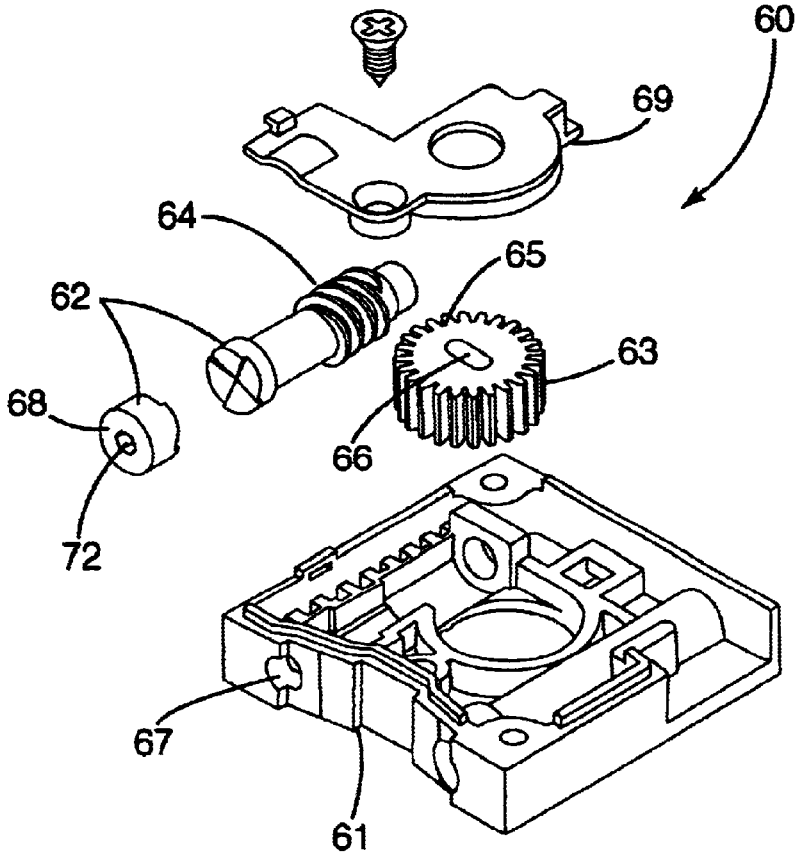
FIG. 11 is an exploded view of the gear assembly.

FIG. 11 shows the gear assembly 60, which includes a gear subassembly 61, worm 62, and worm gear 63. The worm 62 has teeth 64 that lock with the teeth 65 of the worm gear 63. There is also a cap 69 for keeping the worm 62 and worm gear 63 in contact, which can be attached to the gear subassembly 61. The worm gear 63 also has a spring slot 66 for insertion of the spring subassembly 25. As the pictured worm 62 is rotated in one direction, the teeth 65 of the worm gear 63 are advanced. The worm gear 63 then rotates, causing the spring subassembly 25 to rotate, and increasing the degree to which the coil spring 24 is compressed. The greater the compression of the coil spring 24, the greater the speed and force with which the screen 16 will be retracted. Similarly, if the worm 62 is rotated in the opposite direction, the rotary gear 63 rotates in such a manner as to reduce the compression of the coil spring 24.

The gear subassembly 61 has an access hole 67 on one side. This access hole 67 is accessible to a user after construction of the screen door 10. The head 68 of the worm 62 should be designed to be rotated by an appropriate tool, thus allowing a user to adjust the tension on the coil spring 24. The access hole 67 should be large enough to allow insertion of a tool to rotate the worm gear 62. This will allow the user to determine the tension of the coil spring 24, and thus the speed of retraction of the screen 16. The location of the gear assembly 60 on the screen door 10 should allow easy access to the access hole 67.

Figure 12:
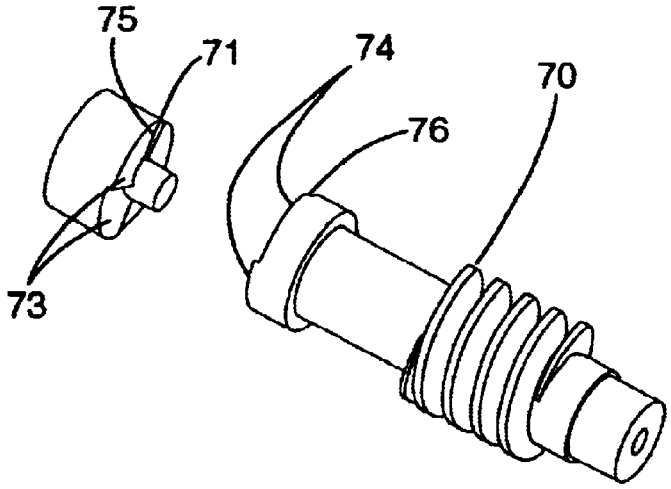
FIG. 12 is an exploded view of the worm and clutch assembly.

FIG. 12 shows a preferred embodiment of the worm 62, including a gear member 70 and adjustment member 71. A tool aperture 72 is formed in the head of the adjustment member 71, into which a tool can be inserted through access hole 67 to rotate adjustment member 71. The adjustment member 71 includes adjustment teeth 73. Gear teeth 74 on the gear member 70 are designed to lock with the adjustment teeth 73 so as to allow rotation of the gear member 70 and adjustment member 71 together when a tool is inserted into the tool aperture 72. When the adjustment member 71 is rotated in one direction the frictional force between the adjustment member 71 and the gear member 70 causes the gear member 70 to rotate in the same direction. This rotation compresses the coil spring 24 as explained above.

A ramped engagement between gear member 70 and adjustment member 71 limits the maximum torque that can be transmitted from adjustment member 71 to gear member 70. The maximum spring compression is defined by the frictional force between the gear member 70 and adjustment member 71. After the coil spring 24 has been compressed a certain amount, the force required to compress the coil spring 24 will be greater than the frictional force between the adjustment member 71 and the gear member 70. At this point the adjustment member 71 slides along the gear member 70, the gear member 70 will not be rotated, and thus the coil spring 24 will not be further compressed. This maximum spring compression will vary depending on the spring used, and the shape of the interlocking adjustment teeth 73 and gear teeth 74. This feature increases the safety of the screen door 10 because the retraction force and speed is limited by the maximum spring compression.

In addition, due to the configuration of the preferred worm 62, no matter how tight the coil spring 24 is compressed, it can always be loosened. When rotated in the opposite direction, the front face 75 of each adjustment tooth 73 pushes against the back face 76 of a gear tooth 74, thus locking together the gear member 70 and adjustment member 71. Since the force required to unlock the teeth when rotated in the opposite direction is greater than the frictional force used to compress the coil spring 24, even if the coil spring 24 is at the maximum spring compression, the compression of the coil spring 24 should be easily reduced.

In an alternative embodiment, there are two pillar housings 11 and no solid pillar 17. One pillar housing 11 is located on each side of a door opening. Each pillar slot 30 should face the door opening. In this configuration, when a handle 12 is pulled from the corresponding pillar slot 30 it will extend the screen 16 across the door opening. Each pillar housing 11 is abutted to an upper rail 13 and a lower rail 14. These will be located in the same positions as in the previous embodiments. When the screens 16 are fully extended the handles 12 will butt against each other and form a seal. The handles 12 can latch together using a traditional latch mechanism, or can latch using the novel latch mechanism previously disclosed. If the novel latch mechanism is used, each pillar housing 11 can have corresponding upper and lower rails, 13 and 14 respectively, with the ribs 37 removed at the end where the rails come in contact. Alternatively there can be one upper rail 13 and one lower rail 14 with ribs 37 removed in the middle. This configuration is useful when installing the retractable screen in front of double doors, such as French doors.

Preferably the framing members are designed to appear to be a symmetrical door casing. The pillar housing 11 and solid pillar 17 have the same outward appearance, and this appearance is that of door molding. The pillar housing 11 has an interior opening to house the screen assembly previously discussed. Additionally, the mantle 18 is molded into the shape of a normal door mantle. These members preferably have the shape shown or the shape of copending design application for DOOR MOLDING filed the same day as this application with inventors David A. DeBlock, Michael J. Kowalczyk and Michael S. Eveland. The lower rail 14 will blend with the door casing if attached to the doorsill 15 in the manner previously described.

There are many methods known in the art for producing the desired shape for the pillar housing 11. For example, the pillar housing 11 could be either an aluminum or plastic extrusion. Any method suitable for producing the pillar housing 11 could also be used to produce upper rail 13 and lower rail 14. Many methods are known in the art for producing the solid pillar 17 and mantle 18 as well. For example, the solid pillar 17 and mantle 18 could be plastic extrusions or milled from wood.

The above descriptions are those of preferred embodiments of the invention. Various alterations and changes can be made without departing from the spirit and broader aspects of the invention as defined in the appended claims, which are to be interpreted in accordance with the principles of patent law including the Doctrine of Equivalents.

What is claimed is:

1. A retractable rolling screen comprising:

a flexible screen attached to a vertically mounted take-up shaft along one edge capable of being wound around said take-up shaft, said take-up shaft being rotatable;

a handle vertically mounted on the free end of the screen for advancing the screen having a bottom end cap and a top end cap;

a spring assembly including a coil spring and spring subassembly attached to one end of said take-up shaft;

a gear assembly attached to the end of the spring subassembly opposite the take-up shaft;

a vertically mounted pillar housing enclosing the take-up shaft having a slot for extension of the screen across an opening and through which the handle protrudes;

a vertically mounted solid pillar;

a horizontally mounted lower rail contacting both the solid pillar and the pillar housing, having a slot through which the screen is guided during extension, the width of said slot being less than the width of said bottom end cap;

an upper rail located horizontally between the solid pillar and pillar housing so as to contact both members, having a guide ledge and a slot through which the screen is guided during extension, the width of said slot being less than the width of said top end cap;

a number of ribs rising from the guide ledge running the length of the upper rail from the pillar housing to the solid pillar and a number of ribs rising from the bottom of the lower rail running the length of the lower rail from the pillar housing to the solid pillar, the ribs in the upper rail ending prior to the end of the upper rail closest to the solid pillar providing enough room for the top end cap to slip off the ribs and rest on the guide ledge, and the ribs in the lower rail ending prior to the end of the lower rail closest to the solid pillar providing enough room for the bottom end cap to slip off the ribs and rest in the lower rail.

2. The retractable screen of claim 1, wherein the ribs in the upper rail and lower rail are of equal heights and end prior to the end of the upper rail and lower rail closest to the solid pillar providing enough room for the top end cap and bottom end cap to slip off the ribs.

3. A retractable rolling screen comprising:

a flexible screen attached to a vertically mounted take-up shaft along one edge capable of being wound around said take-up shaft, said take-up shaft being rotatable;

a handle vertically mounted on the free end of the screen for advancing the screen having a bottom end cap and a top end cap;

a spring assembly including a coil spring and spring subassembly attached to one end of said take-up shaft;

a gear assembly attached to the end of the spring subassembly opposite the take-up shaft;

a vertically mounted pillar housing enclosing the take-up shaft having a slot for extension of the screen across an opening and through which the handle protrudes;

a vertically mounted solid pillar;

a horizontally mounted lower rail contacting both the solid pillar and the pillar housing, having a slot through which the screen is guided during extension, the width of said slot being less than the width of said bottom end cap;

an upper rail located horizontally between the solid pillar and pillar housing so as to contact both members, having a guide ledge and a slot through which the screen is guided during extension, the width of said slot being less than the width of said top end cap;

a number of ribs rising from the guide ledge running the length of the upper rail from the pillar housing to the solid pillar and a number of ribs rising from the bottom of the lower rail running the length of the lower rail from the pillar housing to the solid pillar, the height of the ribs in the upper rail being less than the height of the ribs in the lower trail.

4. A retractable rolling screen comprising:

a flexible screen attached to a vertically mounted take-up shaft along one edge capable of being wound around said take-up shaft, said take-up shaft being rotatable;

a handle vertically mounted on the free end of the screen for advancing the screen;

a spring assembly including a coil spring and spring subassembly attached to one end of said take-up shaft;

a gear assembly attached to the end of the spring subassembly opposite the take-up shaft;

a vertically mounted pillar housing formed to have the appearance of a door molding enclosing the take-up shaft having a slot for extension of the screen across an opening and through which the handle protrudes;

a vertically mounted solid pillar the same size as the pillar housing having an identical outward appearance;

a horizontally mounted lower rail contacting both the solid pillar and the pillar housing, having a slot through which the screen is guided during extension;

an upper rail located horizontally between the solid pillar and pillar housing so as to contact both members, having a slot through which the screen is guided during extension;

a latch mechanism for latching the handle when the screen is in an extended position; and a top end cap attached to the top of the handle, a bottom end cap attached to the base of the handle, a number of ribs rising from the guide ledge running the length of the upper rail from the pillar housing to the solid pillar and a number of ribs rising from the bottom of the lower rail running the length of the lower rail from the pillar housing to the solid pillar, the ribs in the upper rail stopping prior to the end of the upper rail closest to the solid pillar providing enough space for the top cap to slip off the ribs and rest on the guide ledge, and the ribs in the lower rail stopping prior to the end of the lower rail closest to the solid pillar providing enough space for the bottom end cap to slip off the ribs.

5. A retractable rolling screen comprising:

a flexible screen attached to a vertically mounted take-up shaft along one edge capable of being wound around said take-up shaft, said take-up shaft being rotatable;

a handle vertically mounted on the free end of the screen for advancing the screen;

a spring assembly including a coil spring and spring subassembly attached to one end of said take-up shaft;

a gear assembly attached to the end of the spring subassembly opposite said take-up shaft, said gear assembly including a housing, a worm and a worm gear, the worm comprising an adjustment member and a gear member, said adjustment member having adjustment teeth and said gear member having gear teeth, said adjustment teeth rampingly interlocking with said gear teeth, an access hole in the housing;

a vertically mounted pillar housing enclosing the take-up shaft having a slot for extension of the screen across an opening and through which the handle protrudes;

a vertically mounted solid pillar;

a horizontally mounted lower rail contacting both the solid pillar and the pillar housing, having a slot through which the screen is guided during extension;

an upper rail, located horizontally between the solid pillar and pillar housing so as to contact both members having a slot through which the screen is guided during extension; and a latch mechanism for latching the handle when the screen is in an extended position.

6. The retractable screen of claim 5, further including a top end cap attached to the top of the handle, a bottom end cap attached to the base of the handle, a number of ribs rising from the guide ledge running the length of the upper rail from the pillar housing to the solid pillar and a number of ribs rising from the bottom of the lower rail running the length of the lower rail from the pillar housing to the solid pillar.

7. The retractable screen of any of claims 1–3 or 5, further including brush slots in the lower rail and upper rail, and brushes inserted into the brush slots oriented to contact the screen as the screen is extended and retracted.

8. A latching retractable screen door comprising:

a first horizontal rail having a pair of ends and including a first horizontal traveler portion that extends from one end to a position proximate the other end;

a roller screen including a first follower suspended from and riding on said first traveler portion, said follower dropping off said traveler portion proximate said other end to act as a latch to prevent said roller screen from retracting.

9. The latching retractable screen door of claim 8, further including:

a second horizontal rail having a pair of ends and including a second horizontal traveler portion that extends from one end to a position proximate the other end;

a roller screen including a second follower riding on said second traveler portion, said second follower dropping off said traveler portion proximate said other end to act as a latch to prevent said roller screen from retracting.

10. The latching retractable screen door of claim 9, wherein the second horizontal traveler portion is incorporated into the sill or jamb of the framing members of an opening.

11. The latching retractable screen door of claim 8, 9, or 10, wherein said first horizontal traveler portion and said second horizontal traveler portion include means for providing linear contact support for the followers.

12. A retractable screen door comprising:

a roller screen having a shaft and a screen fabric wound there around;

a recoil means for exerting a torsional force on said shaft; and a manually rotatable adjustment means for adjusting said recoil means to change the torsional force on said shaft, said adjustment means including first and second shaft portions connected by a clutch, said clutch permitting a greater force to be translated from said first shaft portion to said second shaft portion in a first rotatable direction than in a second opposite rotatable direction.

13. The retractable screen door of claim 12, wherein said first shaft member is an adjustment member and said second shaft member is a gear member, said adjustment member having adjustment teeth and said gear member having gear teeth, said clutch operating by said adjustment teeth rampingly interlocking with said gear teeth to allow greater force to be applied to the adjustment member when rotating the gear member in one direction than when rotating the gear member in the opposite direction.

14. A doorsill comprising:

a front portion facing away from a building in which said doorsill is installed;

a rear portion facing toward a building in which said doorsill is installed;

a platform portion extending between said front portion and said rear portion;

an adjustment mechanism within said doorsill including first and second rotatable members, said first member adapted to cooperate with a retractor mechanism on a roller screen, said first member being manually rotatable and coupled to said second member, said first member being accessible through said front portion of said doorsill, said first member including first and second shaft portions connected by a clutch, said clutch permitting a greater force to be translated from said first shaft portion to said second shaft portion in a first rotatable direction than in a second opposite rotatable direction.

15. The doorsill of claim 14, wherein said first shaft member is an adjustment member and said second shaft member is a gear member, said adjustment member having adjustment teeth and said gear member having gear teeth, said clutch operating by said adjustment teeth rampingly interlocking with said gear teeth to allow greater force to be applied to the adjustment member when rotating the gear member in one direction than when rotating the gear member in the opposite direction.

16. The doorsill of claim 14 or 15, wherein said first member is accessible from the horizontal direction through the front portion of said doorsill.

* * * * *